US008978665B2

(12) United States Patent
Liu et al.

(10) Patent No.: US 8,978,665 B2
(45) Date of Patent: Mar. 17, 2015

(54) NAIL POLISH DEVICE

(71) Applicants: Samantha Liu, Niskayuna, NY (US); Jie Jerry Liu, Niskayuna, NY (US); Zhiqiang Liu, Bridgewater, NJ (US)

(72) Inventors: Samantha Liu, Niskayuna, NY (US); Jie Jerry Liu, Niskayuna, NY (US); Zhiqiang Liu, Bridgewater, NJ (US)

( * ) Notice: Subject to any disclaimer, the term of this patent is extended or adjusted under 35 U.S.C. 154(b) by 0 days.

(21) Appl. No.: 14/287,047

(22) Filed: May 25, 2014

(65) Prior Publication Data

US 2014/0352709 A1 Dec. 4, 2014

Related U.S. Application Data

(60) Provisional application No. 61/830,154, filed on Jun. 2, 2013.

(51) Int. Cl.

| | |
|---|---|
| ***A45D 29/18*** | (2006.01) |
| ***A45D 29/00*** | (2006.01) |
| ***B26B 13/22*** | (2006.01) |
| ***A45D 34/04*** | (2006.01) |

(52) U.S. Cl.

CPC ..... *A45D 34/04* (2013.01); *A45D 29/007* (2013.01); *A45D 29/00* (2013.01)

USPC ..... 132/74.5; 132/73.5; 132/73

(58) Field of Classification Search

CPC ..... A45D 29/00; A45D 34/04; A45D 34/042; A45D 34/043; A45D 34/045; A45D 29/007; A45D 29/11; A45D 29/12; A45D 29/18; A45D 29/20; A45D 44/02; A45D 44/264

USPC ..... 132/74.5, 200, 73, 73.5, 75, 75.3, 76.5, 132/285, 317, 318, 320, 902; 206/581, 823, 206/229, 363; 401/6, 7, 49, 48, 261, 127, 401/118, 119, 129; 15/167.1, 167.3; 55/318, 356, 385.2; 220/284, 661, 696, 220/697, 735, 736, 767–770, 775, 776; 454/56

See application file for complete search history.

(56) References Cited

U.S. PATENT DOCUMENTS

| | | | | | |
|---|---|---|---|---|---|
| 1,954,068 | A | * | 4/1934 | Carpenter | 401/127 |
| 2,583,729 | A | | 1/1952 | Deanesly | |
| 2,771,621 | A | * | 11/1956 | Erickson | 132/74.5 |
| 2,980,940 | A | * | 4/1961 | Crowe | 15/104.94 |
| 4,255,826 | A | * | 3/1981 | Boyd | 15/21.1 |
| 4,359,060 | A | * | 11/1982 | Walker | 132/75 |
| 4,647,295 | A | * | 3/1987 | Christ | 95/284 |
| 4,852,468 | A | * | 8/1989 | Harris | 454/56 |
| 4,964,372 | A | * | 10/1990 | Zeenni et al. | 132/74.5 |
| 5,112,373 | A | * | 5/1992 | Pham | 96/142 |
| 5,139,546 | A | * | 8/1992 | Novobilski | 96/142 |
| 5,336,128 | A | * | 8/1994 | Birdsong | 454/56 |
| 5,395,166 | A | * | 3/1995 | Watson | 312/244 |
| 5,464,029 | A | * | 11/1995 | Rentz | 132/73.5 |
| 5,787,903 | A | * | 8/1998 | Blackshear | 132/73.5 |
| 5,960,798 | A | * | 10/1999 | Jenkins et al. | 132/73 |

(Continued)

*Primary Examiner* — Vanitha Elgart

(57) ABSTRACT

The invention provides a nail polish device for applying or removing nail polish. The nail polish device comprises a liquid delivering material for delivering a liquid nail polish or liquid nail polish removing composition; a main body structure substantially enclosing the liquid delivering material with an opening for receiving the fingers or toes of the user during use; and a vapor inhibiting material disposed on the main body structure, along the surface proximal to the liquid delivering material. The vapor inhibiting material is effective in inhibiting vapors and/or excess liquids from the liquid nail polish or removing composition by either absorbing same and/or neutralizing same.

20 Claims, 5 Drawing Sheets

(56) References Cited

U.S. PATENT DOCUMENTS

| | | | | |
|---|---|---|---|---|
| 6,302,947 | B1 * | 10/2001 | Rees, Jr. | 96/329 |
| 6,338,675 | B2 * | 1/2002 | Winkelman | 454/56 |
| 6,405,735 | B1 | 6/2002 | Dockery | |
| 6,444,002 | B1 * | 9/2002 | Mai | 55/385.1 |
| 6,530,709 | B1 | 3/2003 | Washington | |
| 6,698,360 | B2 * | 3/2004 | Park | 108/50.13 |
| 6,708,697 | B1 * | 3/2004 | Ziff | 132/73 |
| 7,157,411 | B2 * | 1/2007 | Rohde et al. | 510/106 |
| 7,640,937 | B1 * | 1/2010 | Scott | 132/74.5 |
| 8,322,352 | B2 * | 12/2012 | Lampugnale | 132/74.5 |
| 8,662,091 | B2 * | 3/2014 | Jang | 132/320 |
| 2002/0132861 | A1 * | 9/2002 | Uchiyama et al. | 516/198 |
| 2004/0069314 | A1 * | 4/2004 | Kim | 132/74.5 |
| 2005/0066987 | A1 * | 3/2005 | Perlman | 132/74.5 |
| 2007/0238404 | A1 * | 10/2007 | Park et al. | 454/56 |
| 2008/0223384 | A1 * | 9/2008 | Zabari | 132/73.5 |
| 2009/0081936 | A1 * | 3/2009 | Luu | 454/49 |
| 2009/0090376 | A1 | 4/2009 | Wang | |
| 2010/0200010 | A1 * | 8/2010 | Ton | 132/73.5 |
| 2012/0145004 | A1 * | 6/2012 | Nguyen | 95/285 |
| 2013/0136712 | A1 * | 5/2013 | Woo et al. | 424/76.1 |
| 2013/0252524 | A1 * | 9/2013 | Lavender | 454/66 |
| 2013/0298926 | A1 * | 11/2013 | Smeragliuolo | 132/75 |

* cited by examiner

NAIL POLISH DEVICE

This application claims priority of Provisional Application Ser. No. 61/830,154, filed Jun. 2, 2013.

FIELD OF THE INVENTION

The present invention relates to a nail polish device that can be used to apply and/or remove nail polish, particularly a nail polish device that minimizes the release of harmful solvents and other ingredients into the ambient environment during application or removal of nail polish, and more particularly a nail polish device that minimizes the release of harmful solvents and other ingredients into the ambient environment during application or removal of nail polish by enclosing the vapors from such solvents and ingredients in a substantially closed space and absorbing and/or neutralizing said vapor using vapor inhibiting actives disposed on the surface of the enclosure.

BACKGROUND OF THE INVENTION

Nail polish devices of the present invention include nail polish applicators and removers.

Nail polish applicator has been provided in varied formats. Liquid nail polish is typically supplied in small bottles and applied with a brush that is attached to the bottle's screw-on cap. Liquid nail polish is also supplied using a pen-shaped device, such as that disclosed in U.S. Pat. No. 6,530,709.

Nail polish remover typically comprises an absorbent material. The absorbent material is used to deliver a liquid that is capable of dissolving the lacquer on a nail. One commonly used remover is a cotton ball, and another example is a natural material or synthetic absorbent woven or nonwoven material, such as those discussed in U.S. Pat. No. 6,405,735, and US Appl. Publ. No. 20090090376, and referenced cited therein.

Liquid nail polish and liquid nail polish removing formulation typically comprise harmful organic compounds that can be released into the ambient air during use. For example, liquid nail polish comprises a volatile solvent such as ethyl acetate or butyl acetate. Ethyl acetate has been recognized as an irritant and flammable material. Butyl acetate is also known to be flammable. Liquid nail polish remover traditionally comprises acetone. Acetone has a pungent smell, and is considered irritating and highly flammable. Acetonitrile has also been used as a solvent for nail polish remover and it is known to be a toxic and flammable solvent. Ethyl acetate has also been employed as a replacement for acetone in nail polish remover. Examples of some other harmful organic compounds found in some nail polish and nail polish removing formulations include propylene carbonate, dimethyl glutarate, dimethyl succinate, tocopheryl acetate, denatonium benzoate, propylene glycol, camphor, and isopropyl alcohol.

With conventional nail polish applicators and removers, the harmful volatile organic compounds can be released into the ambient environment, leading to air pollution and discomfort of the persons present in close proximity. The volatile organic compounds readily evaporate from the brushes of the nail polish applicators, and from the absorbent material of the remover, which is impregnated with the remover preparation during use. The vapors of the harmful volatile organic compounds pollute the ambient air, particularly in a substantially closed environment with limited air exchange with the atmosphere. The vapors may also lead to acute discomfort of the persons in close proximity as well as chronic health conditions upon repeated exposure. For example, acetone vapor is known to possess an unpleasant smell, can cause eye irritation and bronchial irritation.

SUMMARY OF THE INVENTION

The present invention concerns a nail polish device for applying or removing nail polish. The nail polish device comprises 1, a liquid delivering means for delivering a liquid nail polish or liquid nail polish removing composition; 2, a main body structure substantially enclosing the liquid delivering means with an opening for receiving the fingers or toes of the user during use; and 3, a vapor inhibiting material disposed on the main body structure, along the surface proximal to the liquid delivering means, said vapor inhibiting material being effective in inhibiting vapors and/or excess liquids from the liquid nail polish or removing composition by either absorbing the same and/or neutralizing the same.

The liquid delivering means can be in any suitable form so long it can be used to effectively deliver liquid nail polish or nail polish removing composition to a nail surface. One example of the liquid delivering means include an absorbent material, such as a cotton ball, rayon, a sponge, a foam, a fabric or a pad manufactured from natural or synthetic woven and nonwoven material. Another example of the liquid delivering means includes a brush.

The main body structure substantially encloses the liquid delivery means so that vapors released from the liquid nail polish or removing composition are trapped within the confines of the main body structure during use. The main body structure can be generally in the shape of a bell, a shell, a cap, a dome, or in any form comprising a continuous layer of material so shaped to define an opening and a recess extending from said opening.

The main body structure has an opening for receiving the fingers or toes of the user. During use, a finger or toe is inserted into the opening, and the nail comes into contact with the liquid delivery means. The main body structure and the finger or toe combine to convert said recess into a space substantially closed and isolated from the ambient environment. Thereafter, a nail polish can be applied from the liquid delivering means or the lacquer can be dissolved upon contact with the removing composition in the liquid delivering means.

The main body structure has a vapor/liquid inhibiting composition on its inner surface, which is the surface of the main body structure proximal to the recess and to the liquid delivering means. The vapor/liquid inhibiting material comprises one or more vapor inhibiting active and/or a liquid inhibiting active, and may further comprise a carrier for the actives. The vapor/liquid inhibiting material can absorb the vapor and/or liquid, and/or neutralize the same. During use, the vapors released from the liquid nail polish or removing composition permeate the substantially closed space and are in contact with the inhibiting composition on the structure's inner surface. The inhibiting composition can entrap and/or neutralize the vapors. If there is excess liquid, the inhibiting composition can entrap and/or neutralize it as well. The end result of the entrapment and/or neutralization is less release of vapor and/or liquid into the ambient environment.

It is an object of this invention to provide a nail polish applicator that can minimize the release of harmful vapors into the ambient environment during use.

It is another object of this invention to provide a nail polish remover that can minimize the release of harmful vapors into the ambient environment during use.

It is a further object of this invention to provide a nail polish applicator or a remover that comprises a vapor/liquid inhibiting composition.

It is yet another object of this invention to provide a nail polish applicator or remover that comprises a liquid delivering means, a structure for enclosing said liquid delivering means, and a vapor/liquid inhibiting composition disposed on the surface of the enclosure, which is the surface proximal to the liquid delivering means.

It is still a further object of this invention to provide a nail polish applicator or remover that comprises a liquid delivering means, a structure for enclosing said liquid delivering means, a vapor/liquid inhibiting composition disposed on the surface of the enclosure, which is the surface proximal to the liquid delivering means, and a holding means that is connected to the liquid delivering means either directly, or indirectly (e.g., through their separate connections to the structure).

It is still another object of this invention to provide a nail polish applicator or remover that comprises a liquid delivering means, a structure for enclosing said liquid delivering means, a vapor/liquid inhibiting composition disposed on the surface of the enclosure, which is the surface proximal to the liquid delivering means, and at least one hole on said structure permitting the insertion of a finger or toe for application.

BRIEF DESCRIPTION OF THE DRAWING

The foregoing aspects and other features of the present invention are explained in the following description, taken in connection with the accompanying drawings, wherein.

DETAILED DESCRIPTION OF THE INVENTION

Figure 1:
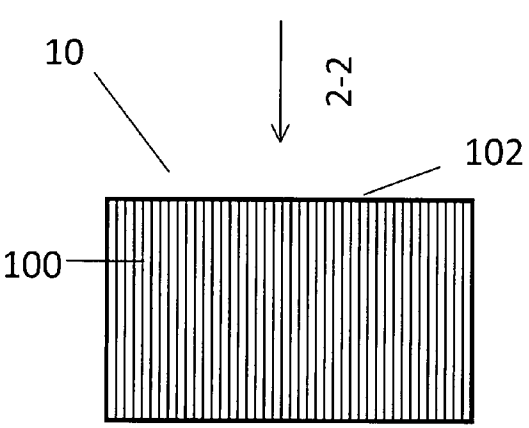
FIG. 1 is a side view of the nail polish device according to a first embodiment of the invention.

Reference will now be made in detail to several embodiments of the invention that are illustrated in the accompanying drawings. Wherever possible, same or similar reference numerals are used in the drawings and the description to refer to the same or like parts or steps. The drawings are in simplified form and are not to precise scale. For purposes of convenience and clarity only, directional terms, such as top, bottom, up, down, over, above, and below may be used with respect to the drawings. These and similar directional terms should not be construed to limit the scope of the invention in any manner. The words "connect," "couple," and similar terms with their inflectional morphemes do not necessarily denote direct and immediate connections, but also include connections through mediate elements or devices. Although the present invention will be described with reference to the identified embodiments as shown in the drawings, it should be understood that the present invention can be embodied in many alternate forms of embodiments. In addition, any suitable size, shape or type of elements or materials could be used.

First Embodiment of the Invention

Referring to FIGS. 1-5, there is shown a nail polish device 10 incorporating features according to a first embodiment of the present invention. The nail polish device 10 comprises a main body structure 100, a liquid delivering means 120, and a vapor inhibiting material 130.

Figure 2:
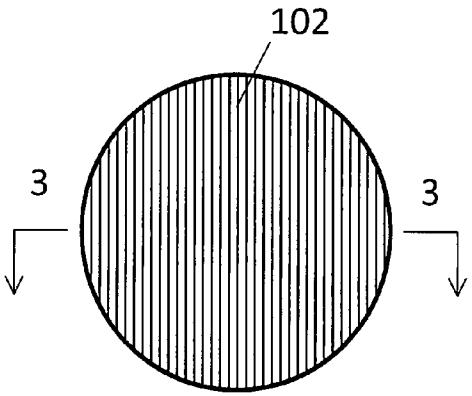
FIG. 2 is the top view of the nail polish device according to the first embodiment, viewed along the line of 2-2.
Figure 3:
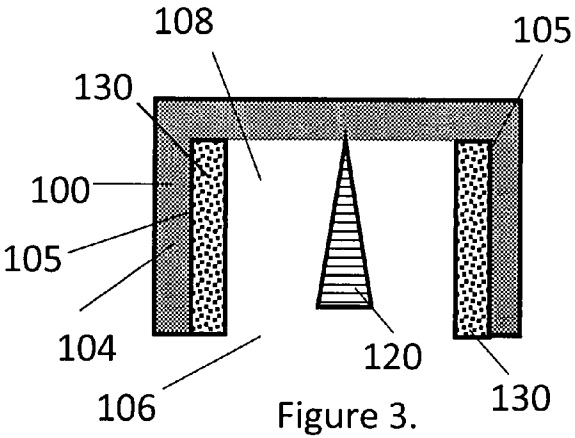
FIGS. 3 and 3*a* are two variations of the cross sectional view of the nail polish device according to the first embodiment, viewed along the line of 3-3.

Referring to FIGS. 1-3, the nail polish device comprises a main body structure 100. The main body structure 100 has a top 102, and a shell 104 extending from said top 102. The distal end of the shell 104 defines an opening 106. The opening 106, the inner surface 105 of the shell 104, and the undersurface of the top 102 combine to define a recess 108.

The main body structure 100 is at least partially visually transparent. The transparency allows the user to observe the application of liquid nail polish or removing liquid in the space of the recess 108. The main body structure 100 is preferably transparent in its entirety to permit the maximum field of view. It is also contemplated that the main body structure 100 is transparent only in portions so long as the view is not severely obstructed. For example, the main body structure 100 can have a transparent top 102 and non-transparent shell 104. Suitable material for manufacturing the transparent portion of the main body structure 100 includes glass, quartz, plastics, polymers and rubbers. Examples of plastics and polymers are polycarbonates such as those produced from the reaction of bisphenol A and phosgene, family of polyacrylates (such as polyacrylate, polymethacrylates, polymethyl acrylate, polyethyl acrylate, polymethyl methacrylates, polybutyl acrylate, and polybutyl methacrylate), polysiloxanes such as polydimethylsiloxane, polyethylene, polypropylene, polystyrene, as well as other polymers. Suitable rubbers include natural rubber as well as siloxane-based rubber. Suitable material for manufacturing the non-transparent portion of the main body structure, if present, can include any synthetic and natural material commonly found in containers, such as glass, plastics, polymers, rubbers, metals, paper and wood.

A liquid delivering means 120 is provided within the recess 108. The liquid delivering means 120 can be in any form suitable for applying liquid nail polish and/or delivering a liquid for dissolving lacquer. The liquid delivering means 120 preferably is attached to the top 102.

Material particularly suitable for applying liquid nail polish includes any material having the ability to absorb and retain fluid, such as a brush, cotton, wool, sponge, felt, sponge, pad or paper. A brush is preferred. When a brush is used, the brush is attached to the top 102 directly or via a stem portion of a material fused, glued or otherwise attached to the material of the top 102, such as a plastic, metal or wood. When other material is used, the liquid delivering means is attached to the undersurface of the top 102 by a commonly used manufacturing means of attachment, such as, for example, a glue compound. The glue compound used as the attachment means must be of a composition not affected by prolonged contact with the nail polish solution.

Material particularly suitable for delivering a liquid for dissolving lacquer can be constructed of any material having the ability to absorb and retain fluid, such as, for example, cotton, wool, sponge, felt, sponge, pad or paper. The liquid delivering means is attached to the undersurface of the top 102 by a commonly used manufacturing means of attachment, such as, for example, a glue compound. The glue compound used as the attachment means must be of a composition not affected by prolonged contact with the nail polish removal solution.

A vapor inhibiting material 130 is provided on the inner surface 105 of the shell 104. Preferably, the vapor inhibiting material 130 is also provided on the undersurface of the top 102. Collectively, the inner surface 105 of the shell 104 and the undersurface of the top 102 are called the host surface.

The vapor inhibiting material can comprise a vapor absorbent material which can effectively absorb the vapors, or a vapor neutralizing material effective in neutralizing the vapors, or a mixture of the two. The vapor absorbent material comprises one or more actives for absorbing vapors, and the vapor neutralizing material comprises one or more actives for neutralizing vapors. Both the vapor absorbent material and the vapor neutralizing material may further comprise a filler material and/or a carrier material, such as zeolite or a sponge. It is noted that the vapor inhibiting material may also function to absorb and/or neutralize excess liquids.

Examples of the absorbent active include activated carbon, zeolite, clay, coffee grounds, tea leaf grounds, baking soda and cyclodextrin (e.g., hydroxypropyl beta-cyclodextrin). The absorbent active can absorb vapors and/or liquids and prevent the same from being released to the ambient environment.

The neutralizing actives differ from the absorbent actives in that the neutralizing actives chemically react with the vapors and turn the vapor or combine with the vapor into a new compound that is not volatile or harmful, while the absorbent actives absorb vapors but maintain the chemical identity of the vapors. An example of the neutralizing actives is a primary amine which can react with acetone and form an imine (Schiff base). When a primary amine is used, acid is preferably added to the vapor neutralizing material to promote the reaction.

The vapor inhibiting material 130 can be provided in the form of a superficial coating on the host surface, or in the form of powders and/or particles partially set into the host surface.

The superficial coating can be in the form of a viscous liquid, powders, particles, liquid/powders/particles attached to the host surface through the use of adhesives, or a porous carrier (such as a sponge or zeolitic material) impregnated with the liquid/powders/particles. In one embodiment, the superficial coating is in the form of a viscous liquid comprising one or more vapor inhibiting active (e.g., vapor absorbent active or vapor neutralizing active) dispersed in a viscous liquid, e.g., tar. In yet another embodiment, the superficial coating comprises a pressure sensitive adhesive impregnated or coated with one or more vapor inhibiting active. Such pressure sensitive adhesive can be any one from the art, including those based on natural rubber, cis-poly(isoprene), cis-poly(butadiene), styrene-isoprene-styrene triblock copolymers, poly(dimethyl siloxane) elastomers, polyisobutylene, poly(ethylene vinylacetate), styrene-co-butadiene random copolymer, poly(urethanes) and acrylonitrile rubbers. FIG. 3 is illustrative of the two preceding embodiments.

Figure 3A:
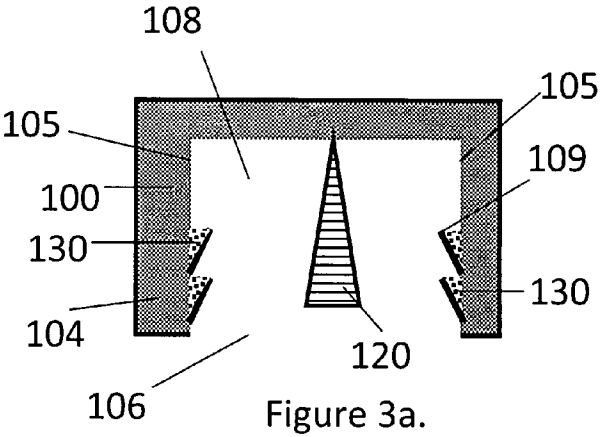

In another embodiment, there is provided at least one reservoir on the host surface, and one or more vapor inhibiting actives are placed within said reservoir. For example, the reservoir can be in the form of cavities on the host surface. Alternatively, at least one protrusion 109 is provided radiating from the host surface into the recess, and the protrusion and the shell 104 form an acute or right angle therebetween and define a reservoir for storing vapor inhibiting material. Preferably, the protrusion runs circumferentially along the inner surface 105 of the shell in one or more full circles or in one or more segments of a circle. FIG. 3*a* is illustrative of this alternative embodiment. This alternative embodiment is particularly preferred because the vapor inhibiting material 130 can be readily replaced and replenished. The protrusion can be produced using any material suitable for making the main body structure.

The vapor inhibiting material 130 can also be in the form of powders/particles at least partially set into the host surface. The powders/particles can be formed from the active per se, or from porous carrier impregnated with the active. The powders/particles can be set into the host surface by contacting the host surface with the powders/particles before the host surface hardens during the manufacturing process of the main body structure 100, if the manufacturing process involves a molten state of the host surface. The powders/particles can also be set into the host surface after the manufacture of the main body structure 100, by applying a heat source to the host surface to raise the temperature of the host surface to a point where the host surface at least partially melts and subsequent contacting the molten surface with particles/powders.

Figure 4:
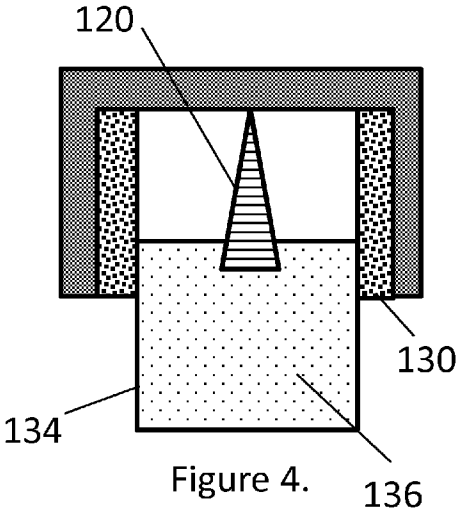
FIG. 4 is the cross sectional view of the nail polish device according to the first embodiment, viewed along the line of 3-3, further showing a bottle of liquid nail polish or nail polish removing liquid.

Referring to FIG. 4, during storage, the nail polish device 10 is placed on top of a container 134 holding a liquid nail polish or nail polish removing liquid 136. A proper seal between the container 134 and the nail polish device 10 can be secured in many ways. The seal can be achieved by a tight fitting between the upper portion of the container 134 and the inner surface (as possibly further extended inward by the inclusion of the vapor inhibiting material 130) of the shell 104. The seal can also be achieved by matching grooves on the inner surface of the shell 104 and on the exterior surface of the upper portion of the container 134. Yet another way for achieving a proper seal is by providing a stopper to the undersurface of the cap 102, said stopper extending downward and having a size and shape matching the opening of the upper portion of the container.

Figure 5:
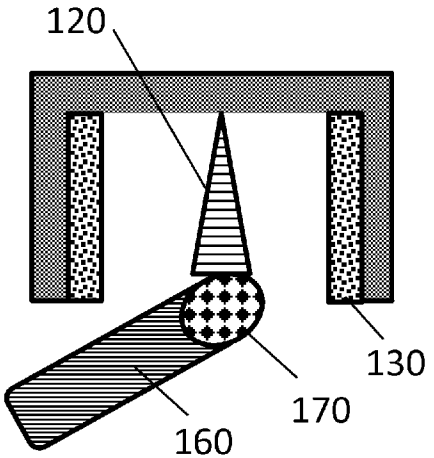
FIG. 5 is the cross sectional view of the nail polish device according to a first embodiment, viewed along the line of 3-3, further showing a finger or toe and a nail during use.

Referring to FIG. 5, during use, the user places a finger/toe 160 at a working area, ensures that the liquid delivering means 120 is soaked with the liquid 136, and moves the nail polish device 10 above the nail to cause the liquid delivering means 120 to come into contact with the nail and move across the area of a nail 170. If the top 102 and/or the shell 104 is composed of rigid material, the structural rigidity requires movement along the same trajectory and to the same extent. Alternatively, if the top 102 and/or the shell 104 is composed of deformable material (such as an elastic polymer or rubber material), the structural flexibility allows movement of the liquid delivering means 120 without requiring movement of the top 102 and/or the shell 104 along the same trajectory, or to the same extent. Any vapor released from the liquid delivering means will be entrapped and/or neutralized by the vapor inhibiting material 130.

Second Embodiment of the Invention

Figure 6B:
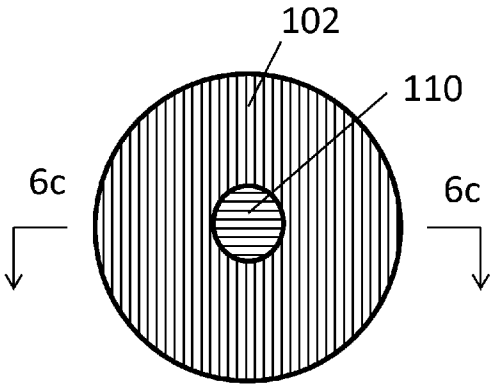
FIG. 6*b* is a top view of the nail polish device according to the second embodiment, viewed along the line of 6*b*-6*b*.
Figure 6A:
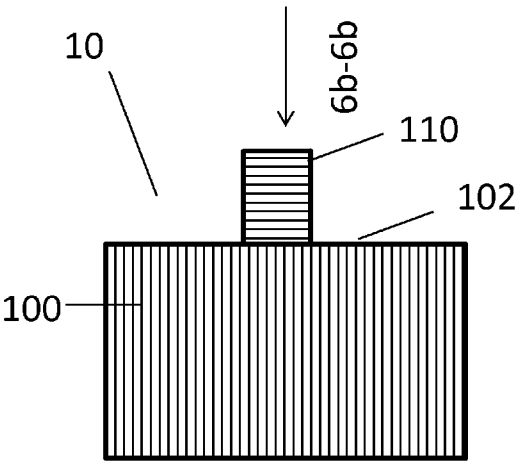
FIG. 6*a* is a side view of the nail polish device according to a second embodiment of the invention.
Figure 7A:
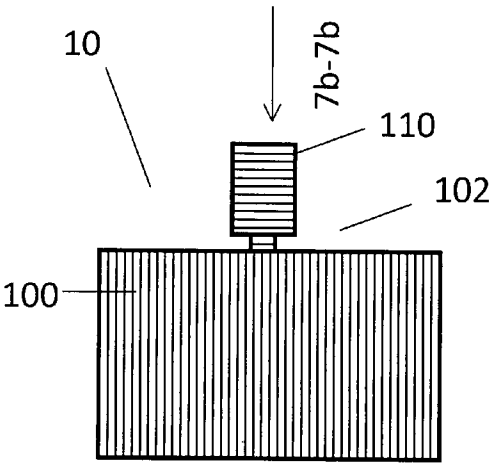
FIG. 7*a* is a side view of the nail polish device according to a third embodiment of the invention.
Figure 7C:
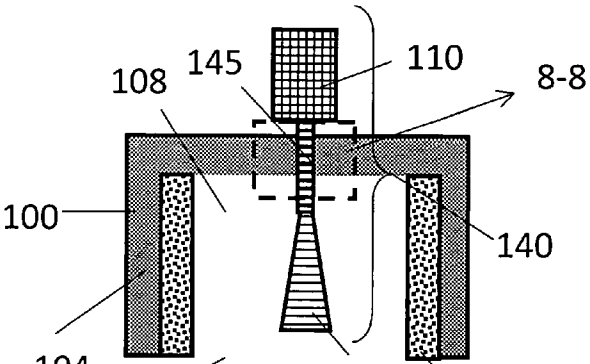
FIG. 7*c* is the cross sectional view of the nail polish device according to the third embodiment, viewed along the line of 7*c*-7*c*.
Figure 6C:
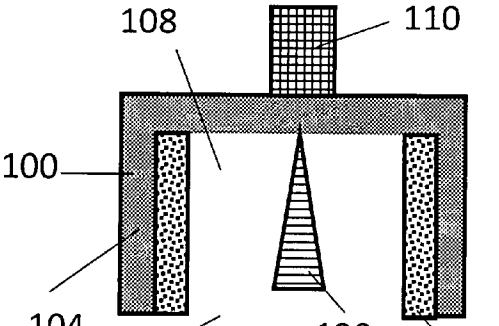
FIG. 6*c* is the cross sectional view of the nail polish device according to the second embodiment, viewed along the line of 6*c*-6*c*.
Figure 7B:
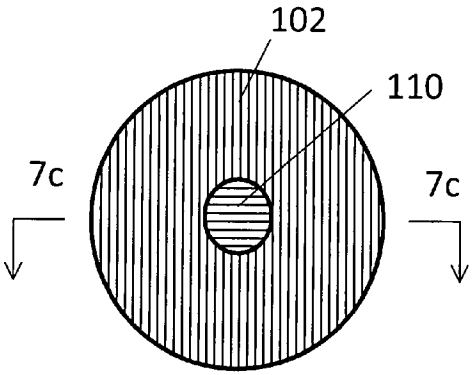
FIG. 7*b* is a top view of the nail polish device according to the third embodiment, viewed along the line of 7*b*-7*b*.

Referring to FIGS. 6*a* to 6*c*, in a second embodiment, the nail polish device 10 comprises a main body structure 100, a liquid delivering means 120, and a vapor inhibiting means 130, all of which as discussed above with reference to the first embodiment with respect to structure, functional, material and variations thereof, and further comprises a holding means 110 for convenient holding by fingers. Such holding means may be in the form of a ring, a knob, a protrusion or any suitable structure by which the user can insert his/her finger for secured handling of the device or can otherwise hold onto the device.

The holding means 110 is coupled to the top 102. The top 102 substantially follows the same trajectory as the holding means 110 during use.

Third Embodiment of the Invention

Referring to FIGS. 7*a* through 7*c*, and 8*a*, in a third embodiment, the nail polish device 10 compromises a main body structure 100, a liquid delivering means 120, a vapor inhibiting means 130, and a holding means 110, wherein the liquid delivering means 120 and the holding means 110 connect to form a unitary structure 140. While all other parts can be as discussed previously in the preceding embodiments, the holding means 110 is not directly coupled to the top 102. Preferably, the nail polish device further comprises a stem portion 145 between the liquid delivering means 120 and the holding means 110, and the stem portion 145 extends through an aperture 150 of the top 102. The gap 148 between the stem portion 145 and the perimeter of the aperture 150 permits lateral and/or pivotal movement of the liquid delivering means 120 without concurrent movement of the top 102. During use, the user can grab the device by the holding means 110, and move the liquid delivering means 120 across a nail without moving the top 102 and/or shell 104 along the same trajectory or the same extent.

Figure 8A:
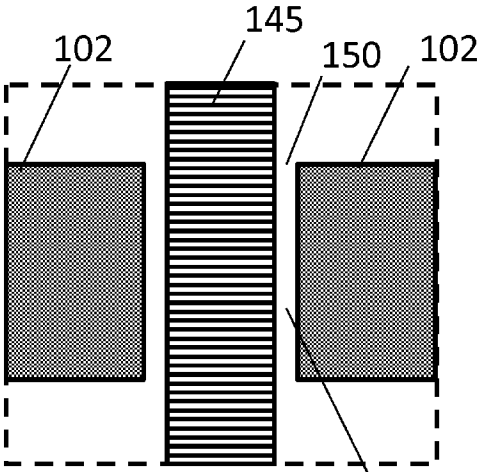
FIGS. 8*a* through 8*d* are the expanded views of the area enclosed by the broken line indicated by 8-8 in FIG. 7*c*, according to the third embodiment.
Figure 8B:
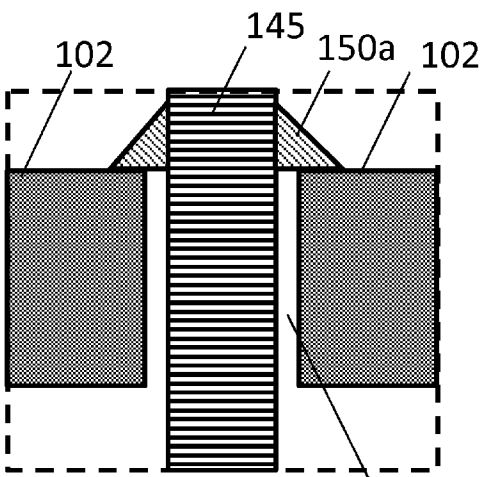

Referring to FIG. 8*b*, preferably, the unitary structure 140 of the second variation further comprises a cap 150*a* above the aperture 150 on top of the top 102. The cap 150*a* extends radially from the stem portion 145 of the unitary structure with a size adequate to cover the entire aperture 150. The cap 150*a* can be an integral part of the stem portion 145 or an add-on. During storage, the cap rests above the aperture, seals the aperture around its perimeter, and prevents escape of the vapors through the opening of the aperture around the unitary structure 140. The cap can be made of any material that is used in the manufacturing of the main body structure 10, and a particularly suitable material is a rubber or a synthetic polymer.

Figure 8C:
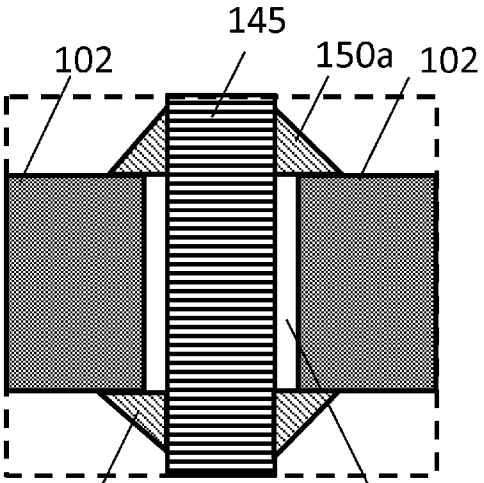

Referring to FIG. 8*c*, still more preferably, the unitary structure 140 of the second variation comprises a first cap 150*a* above the aperture 150 on top of the top 102 and a second cap 150*b* under the aperture at the undersurface of the top 102. The caps extend radially from the stem of the unitary structure with a size adequate to cover the entire aperture 150. The caps 150*a* and 150*b* can be an integral part of the stem portion 145 or an add-on. The caps 150*a* and 150*b* prevent escape of the vapors through the opening of the aperture around the unitary structure 140. The caps 150*a* and 150*b* also function together to define a limited range of vertical freedom of motion for the stem portion 145 of the unitary structure. Of course, the unitary structure may comprise cap 150*b* in the absence of cap 150*a*.

Figure 8D:
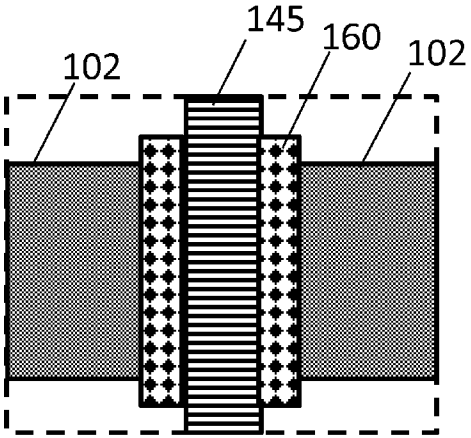

Referring to FIG. 8*d*, more preferably, an elastic seal 160 is provided in the aperture 150 between the unitary structure 140 and the perimeter of the aperture. The elastic seal 160 occupies the gap between the stem portion and the aperture, and prevents escape of the vapors through the gap. The elasticity of the seal 160 permits lateral/pivotal motion of the absorbent material 130 when the user moves the holding means without requiring concurrent motion or deformation of the top 102 and/or shell 104. Therefore, the top 102 and/or the shell 104 can be composed of a rigid or a deformable material.

The elastic seal 160 can be made of any material that is elastic and chemically resistant to the ingredients of the liquid nail polish or a removing composition. Nonexclusive examples of the material for making the elastic seal include unsaturated rubbers (e.g., natural polyisoprene, synthetic polyisoprene, polybutadiene, chloroprene rubber, copolymer of isobutylene and isoprene, styrene-butadiene rubber, copolymer of butadiene and acrylonitrile), saturated rubbers (ethylene propylene rubber, epichlorohydrin rubber, polyacrylic rubber, silicone rubber, fluorosilicone rubber, fluoroelastomers, perfluoroelastomers, polyether block amides, chlorosulfonated polyethylene, ethylene-vinyl acetate), thermoplastic elastomers, the proteins resilin and elastin, polysulfide rubber and elastolefin.

Of course, the elastic seal 160 can be used separately from or in combination with the caps 150*a* and/or 150*b*.

Fourth Embodiment of the Invention

Figure 10:
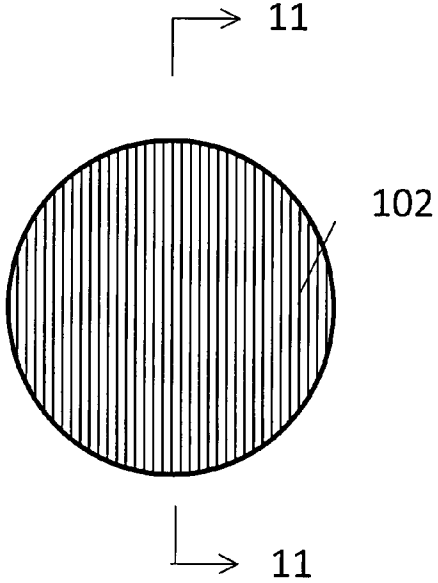
FIG. 10 is the top view of the nail polish device according to the fourth embodiment, viewed along the line of 9-9 in FIG. 9.
Figure 11:
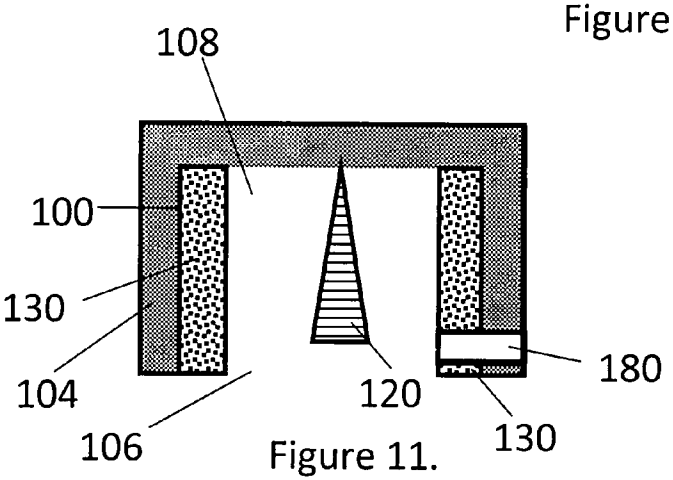
FIG. 11 is the cross sectional view of the nail polish device according to the fourth embodiment, viewed along the line of 11-11.
Figure 9:
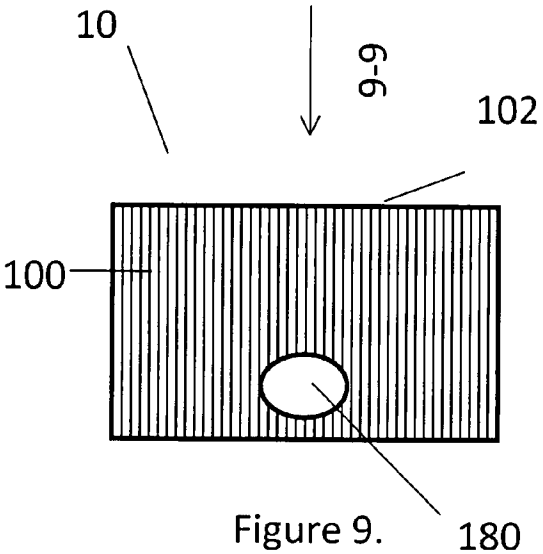
FIG. 9 is a side view of the nail polish device according to a fourth embodiment of the invention.

Referring to FIGS. 9-11, in a fourth embodiment of the invention, the nail polish device 10 comprises a main body structure 100, a liquid delivering means 120, and a vapor inhibiting means 130, all of which as discussed above in the preceding embodiments, and further comprises at least one hole 180 in the shell 104, adapted for receiving one or more fingers or toes.

The hole 180 runs through a wall of the shell 104, and can assume any shape and size suitable for receiving one or more fingers or toes. The hole 180 can be in the shape of a circle, a square, a rectangle, an elliptical, an oval, or any other suitable shapes. The hole 180 is of a suitable size for receiving one or more fingers or toes. The hole 180 is positioned with its upper edge (the edge proximal to the undersurface of the cap 102) at the same height or slightly above the height of the lowest point (distal from the undersurface of the cap 102) of the liquid delivering means 120. Therefore, when a finger or toe is inserted into the hole, the nail is readily in touch with the liquid delivering means 120 to receive the liquid nail polish or removing composition. When used as such, the distal end of the shell 104 can be rested directly on a surface to form a seal between the shell and the surface and prevent escape of vapors from the opening 106. Preferably, an elastic rim is provided along the distal end of the shell 104 to secure a tight seal. A proper seal can also be formed between the finger or toe with the perimeter of the hole 180, further limiting the escape of the vapors.

Although not shown in FIGS. 9-11, the nail polish device 10 of this embodiment preferably further comprises a holding means as described in preceding embodiments. In addition, the nail polish device 10 preferably further comprise the cap(s) and/or seal as described above.

Other Embodiments

The above-mentioned embodiments are examples and should not be construed as the only possible embodiments of the present invention. Many more embodiments and variations can be contemplated without departure from the teaching of the present invention and these embodiments and variations are deemed part of the present invention.

For example, the present invention is also directed to a modified device that can be used in conjunction with commercially available nail polish devices. With a pen-shaped applicator or a brush-shaped applicator, the modified device can comprise a structure 100 as described above, a vapor inhibiting composition 130 as described above, and a hole in the top 102 of the structure. The hole is adapted for receiving the body of said pen-shaped applicator or brush-shaped applicator, so that the part of the applicator that is imbued with the liquid is positioned within the recess 108. If desired, caps 150*a* and/or 150*b* can be placed adjacent to the hole for sealing the hole, or an elastic liner 160 can be provided.

We claim:

1. A nail polish device comprising:
a main body structure having a recess;
a liquid delivering means disposed within said recess of said main body structure;
a vapor inhibiting means disposed within said recess of said main body structure;
a holding means;
an aperture in said main body structure; and
a stem portion;
wherein said stem portion being interposed between and connecting said holding means and said liquid delivering means, and said stem portion extending through said aperture of said main body structure.

2. A nail polish device according to claim 1, wherein said vapor inhibiting means comprises at least one member selected from the group consisting of a vapor absorbent material and a vapor neutralizing material.

3. A nail polish device according to claim 2, wherein said vapor absorbent material comprises at least one member selected from the group consisting of activated carbon, zeolite, clay, coffee grounds, tea leaf grounds, baking soda, cyclodextrin, and hydroxypropyl beta-cyclodextrin.

4. A nail polish device according to claim 2, wherein said vapor neutralizing material comprises a primary amine.

5. A nail polish device according to claim 1, further comprising a first topical seal around said stem portion, said first topical seal being adjacent to said holding means.

6. A nail polish device according to claim 5, further comprising a second topical seal around said stem portion, said second topical seal being adjacent to said liquid delivering means.

7. A nail polish device according to claim 1, further comprising a through-seal, said through-seal surrounding and extending coaxially with said stem portion through said aperture.

8. A nail polish device according to claim 1, further comprising a hole in said main body structure, said hole being adapted and dimensioned for receiving the finger or toe of a subject.

9. A nail polish device according to claim 1, wherein said liquid delivering means is at least one member selected from the group consisting of a brush, cotton, wool, sponge, felt, pad and paper.

10. A nail polish device according to claim 1, further comprising a receptacle with an opening, wherein said opening of said receptacle is encloseable by said recess of said main body structure.

11. A nail polish device according to claim 1, wherein said nail polish device is a nail polish applicator.

12. A nail polish device according to claim 1, wherein said nail polish device is a nail polish remover.

13. A nail polish device comprising:
a main body structure having an aperture and a recess;
a brush disposed within said recess of said main body structure;
activated carbon disposed within said recess of said main body structure;
a holding means; and
a stem portion;
wherein said stem portion being interposed between and connecting said holding means and said brush, and said stem portion extending through said aperture of said main body structure.

14. A nail polish device according to claim 13, further comprising a topical seal around said stem portion, said topical seal being adjacent to said holding means.

15. A nail polish device according to claim 13, further comprising a through-seal, said through-seal surrounding and extending coaxially with said stem portion through said aperture.

16. A nail polish device comprising:
a main body structure having an aperture, a recess, and an inner surface, said inner surface being proximal to said recess;
a liquid delivering means disposed within said recess of said main body structure;
a vapor inhibiting means disposed on said inner surface of said main body structure;
a holding means;
a stem portion; and
wherein said stem portion being interposed between and connecting said holding means and said liquid delivering means, and said stem portion extending through said aperture of said main body structure.

17. A nail polish device according to claim 16, wherein said vapor inhibiting means is disposed as a coating on said inner surface of said main body structure.

18. A nail polish device according to claim 16, wherein said vapor inhibiting means is disposed in the form of solids at least partially set into said inner surface of said main body structure.

19. A nail polish device according to claim 16, wherein said main body structure further comprises:
at least one cavity on said inner surface of said main body structure;
wherein said vapor inhibiting means is disposed within said at least one cavity.

20. A nail polish device according to claim 16, wherein said main body structure further comprises:
at least one protrusion radiating from said inner surface of said main body structure;
wherein said inner surface of said main body structure and said at least one protrusion form at least one reservoir, and wherein said vapor inhibiting means is disposed within said at least one reservoir.

* * * * *